US009545159B2

(12) United States Patent
Wang

(10) Patent No.: US 9,545,159 B2
(45) Date of Patent: Jan. 17, 2017

(54) APPARATUS FOR A BABY CARRIER

(76) Inventor: Suling Wang, San Francisco, CA (US)

( * ) Notice: Subject to any disclaimer, the term of this patent is extended or adjusted under 35 U.S.C. 154(b) by 375 days.

(21) Appl. No.: 12/789,301

(22) Filed: May 27, 2010

(65) Prior Publication Data

US 2011/0290831 A1 Dec. 1, 2011

(51) Int. Cl.
*A47D 13/02* (2006.01)

(52) U.S. Cl.
CPC ..... *A47D 13/025* (2013.01)

(58) Field of Classification Search
CPC A47D 13/025; A47D 13/02; A41D 2400/482; A45F 3/08; A61G 7/1023; B60N 2/2842
USPC ..... 224/160, 159, 158, 161, 646, 647, 637; D3/214; 297/467, 219.12, 219.11
See application file for complete search history.

(56) References Cited

U.S. PATENT DOCUMENTS

| | | | | |
|---|---|---|---|---|
| 1,196,003 | A * | 8/1916 | Lippincott | 224/159 |
| 3,197,100 | A * | 7/1965 | Thompson | 224/160 |
| 4,009,808 | A * | 3/1977 | Sharp | A47D 13/025 224/160 |
| 4,271,998 | A | 6/1981 | Ruggiano | |
| 4,428,514 | A | 1/1984 | Elf | |
| 4,492,326 | A | 1/1985 | Storm | |
| 4,724,988 | A | 2/1988 | Tucker | |
| 4,778,091 | A | 10/1988 | Barto | |
| 5,205,450 | A | 4/1993 | Derosier | |
| 5,222,641 | A | 6/1993 | Medeiros, Jr. | |
| 5,509,590 | A | 4/1996 | Medeiros, Jr. | |
| 5,570,823 | A * | 11/1996 | Lindy | 224/160 |
| 5,678,739 | A | 10/1997 | Darling | |
| 5,690,258 | A | 11/1997 | Kataoka | |
| 5,819,341 | A | 10/1998 | Simantob | |
| 5,987,665 | A | 11/1999 | Simantob | |
| 6,409,060 | B2 | 6/2002 | Donine | |
| 6,415,969 | B1 | 7/2002 | Higuchi | |
| 6,443,339 | B1 | 9/2002 | Higuchi | |
| 6,595,396 | B2 * | 7/2003 | Cummings et al. | 224/158 |
| 7,322,498 | B2 | 1/2008 | Frost | |
| 2004/0155078 | A1 * | 8/2004 | Hwang | 224/160 |
| 2007/0138218 | A1 | 6/2007 | Calilung | |
| 2007/0278264 | A1 | 12/2007 | Chesal | |
| 2007/0284403 | A1 | 12/2007 | Minami | |
| 2009/0101683 | A1 * | 4/2009 | Gilboa et al. | 224/160 |
| 2010/0187269 | A1 * | 7/2010 | Leistensnider | 224/159 |

(Continued)

OTHER PUBLICATIONS

BabyBjorn, "BabyBjorn unveils new comfort carrier", press release on American babybjorn.com website, Mar. 1, 2010, Solna, Sweden.

(Continued)

*Primary Examiner* — Adam Waggenspack
*Assistant Examiner* — Matthew Theis

(57) ABSTRACT

An apparatus includes a seat flap for supporting a baby's buttocks and thighs. The seat flap has a top edge, a bottom edge having a shorter length than a length of the top edge and generally curved side edges. A first strap is joined to a first corner of the top edge for adjustably joining to an upper portion of a baby carrier. A second strap is joined to a second corner of the top edge for adjustably joining to the upper portion. Attachments adjustably join the bottom edge about a lower portion of the baby carrier, wherein the baby sits upright, the baby's legs protrude about the generally curved side edges and are supported at least ninety degrees from the lower portion.

30 Claims, 7 Drawing Sheets

(56) References Cited

U.S. PATENT DOCUMENTS

| | | | | |
|---|---|---|---|---|
| 2011/0042429 | A1* | 2/2011 | Frost | 224/159 |
| 2012/0043359 | A1 | 2/2012 | Bergkvist et al. | |

OTHER PUBLICATIONS

BabyBjorn, BabyBjorn Comfort Carrier product web page, http://www.babybjorn.com/en/American/products/Mobility/BABYBJORN-Comfort-Carrier/ Sweden.
BabyBjorn, "BabyBjorn Comfort Carrier", press release on Swedish Babybjorn.com, Dec. 18, 2009, Solna, Sweden.

* cited by examiner

APPARATUS FOR A BABY CARRIER

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to baby carriers. More particularly, the invention relates to a soft-structured baby carrier that enables the baby to be carried on the caregiver's body.

BACKGROUND OF THE INVENTION

The present invention relates to baby carriers that are used to carry babies in an upright position on the front or back of a caregiver's body. Although this invention could be adapted for use with rigid-frame baby carriers or wrap style baby carriers, preferred embodiments are implemented for use with soft-structured and mei-tai style baby carriers.

Soft-structured and mei-tai style baby carriers usually consist of a flexible baby pouch that secures the baby in an upright position against the front or back of the caregiver's body by means of shoulder straps. There are many variations for how the baby pouch is sized, shaped and constructed. The baby pouch may be constructed as a simple flap of fabric or it may consist of several different components to support the back, front, buttocks or head of the baby. There are also many variations for how and where the shoulder straps connect to the baby pouch. Generally, the baby pouch has two shoulder straps that go over the caregiver's shoulders and either cross in back or loop around the shoulders and attach lower on the baby pouch similar to shoulder straps on a backpack. Soft-structured carriers generally use buckles as a means of attachment. In traditional Asian mei-tais the straps are usually secured by tying knots. Many, but not all, carriers of this type have a waistband that attaches to the bottom of the main body panel so much of the weight of the baby is distributed on the caregiver's hips rather than only on the shoulders for the comfort of the caregiver.

The majority of soft-structured carriers and mei-tais only allow the baby to face into the caregiver's body because allowing the baby to face outwards requires shaping the baby pouch so that the baby's legs can stick out the front by creating a narrow crotch region on the baby pouch. There is debate about whether it is healthy for a baby to be held in this way because, in the facing-out position, the baby's legs hang down and all his weight is concentrated on the narrow crotch region. Some experts believe that it is not healthy for the baby's spine and hip development to be held in this "crotch-dangling" position for long periods of time. Though many of the newer baby carriers that allow babies to face outward attempt to distribute the baby's weight along the baby's buttocks rather than only the baby's crotch, the baby's legs still hang down in a potentially harmful way as the baby's thighs are not supported in carriers with the baby pouch shaped this way and much of the baby's weight is still concentrated on a relatively small area on the baby's body which is potentially unhealthy and not as comfortable for the baby. It is therefore an objective of the present invention to provide a baby carrier that enables the baby to face outward while distributing the weight of the baby over a larger area of the baby's body.

In currently known carriers comprising a baby pouch with no narrow crotch region that only allow the baby to face into the caregiver's body, the baby's legs are usually at a 90-degree or greater angle because the thighs are supported and the baby's legs straddle the caregiver's body. This is considered by many to be a healthier position for the baby's hip and spine development. However, many babies prefer to face out and look at their surroundings and may resist being carried in the facing-in position for a long period of time.

One currently known baby carrier provides a flexible pouch with holes cut out for the baby's legs to stick through at the knees. By forming the pouch so the baby's knees are raised relative to the buttocks, the baby's thighs and buttocks are supported in the front facing-outwards position. However, this design does not easily adjust to accommodate babies of different sizes. The angle of the thigh support is not adjustable, possibly making it uncomfortable for babies that are either too small or too large for the pouch. In addition, if this carrier is not carefully structured with a very deep seat that perfectly fits the baby, the baby's legs may flop out of the pouch and hang down or to the side. Furthermore, in the facing-out position, the baby's torso may not be supported very well because the baby's thighs are by necessity bent up within the pouch in front of the abdomen creating a space between the pouch and the baby's torso.

Another currently known design provides a baby carrier with a thick, rectangular, somewhat-rigid platform that holds up the thighs and buttocks of the baby and allows the baby to be seated while facing out. The seating platform is attached to the baby carrier in a hinge-like manner to create a platform or bench for the baby. However, the seating platform is bulky and does not enable the baby to be turned around to face into the caregiver's body since the platform is enclosed on the two sides with material. Furthermore, the rigid seating platform does not support the baby's torso so that the baby may shift and move around on the seat while being carried.

Other currently known designs provide a rigid-framed baby carrier with a rigid seating platform that supports the baby's thighs in a position in which the baby faces out. However, the rigid-frame is bulky and not convenient for everyday casual use. Also, the rigid seating platform does not support the baby's torso so that the baby may shift and move around on the seat while being carried.

In view of the foregoing, there is a need for improved techniques for providing a baby carrier that enables the baby to be easily carried in multiple positions, including, but not limited to, facing out, while providing the support needed to the various parts of the baby's body.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a ¾ view of the baby carrier in a disassembled state. FIG. 1B is a diagrammatic front view of a main body of the baby carrier. FIG. 1C is a diagrammatic top view of the seat flap, and FIG. 1D is a diagrammatic bottom view of the seat flap;

FIG. 2A is a ¾ view of the baby carrier being worn by a caregiver with the baby in a front carry facing-out position. FIG. 2B is a ¾ view of the baby carrier being worn by the caregiver with the baby in a front carry facing-in position, and FIG. 2C is a ¾ view of the baby carrier being worn by the caregiver with the baby in a back carry position;

Figure 1A:
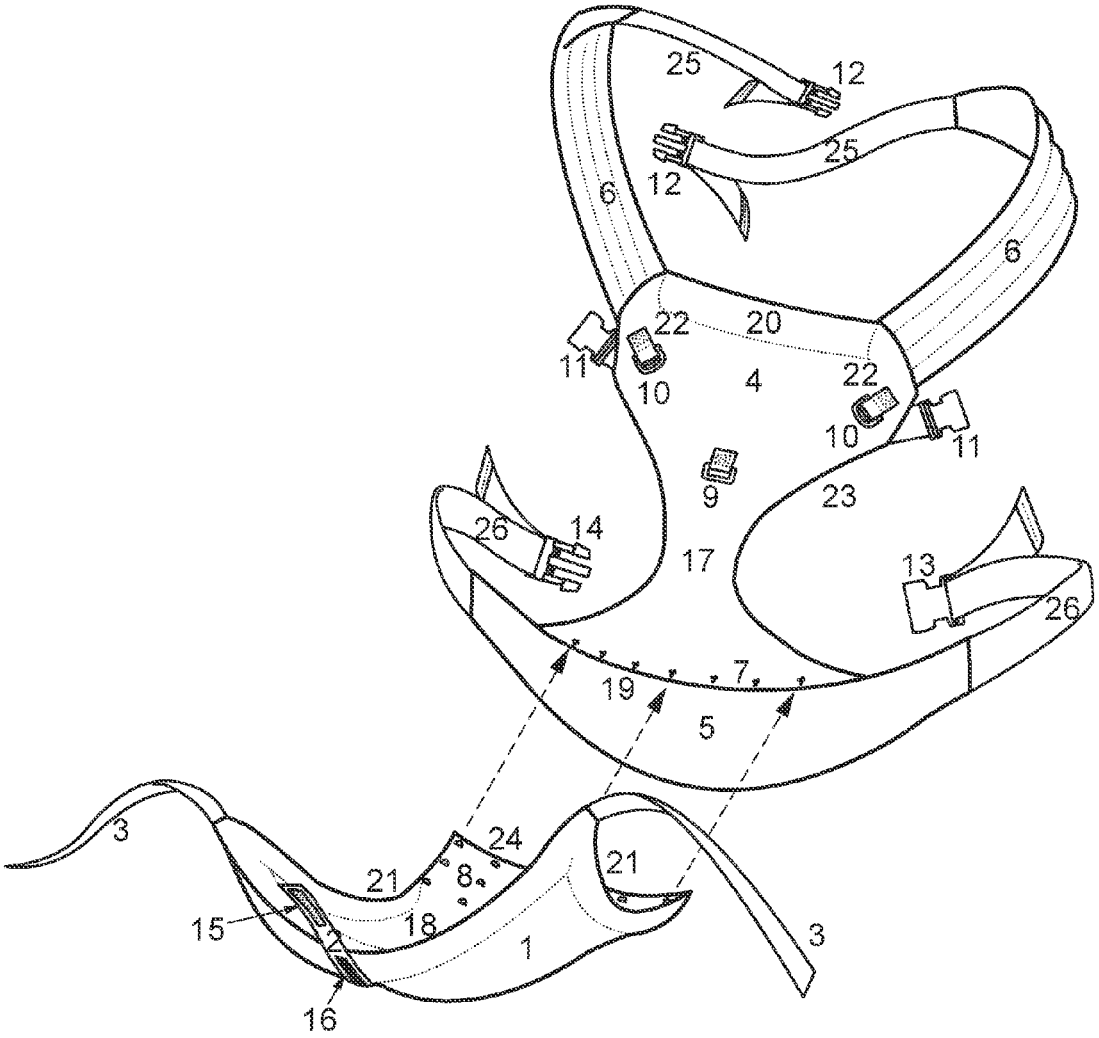
FIGS. 1A through 1D illustrate the anatomy of an exemplary baby carrier with a seat flap, in accordance with an embodiment of the present invention.

Unless otherwise indicated illustrations in the figures are not necessarily drawn to scale.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Preferred embodiments of the present invention provide a baby carrier in the style of a soft-structured carrier or traditional Asian mei-tai in which a baby can be carried on the back or front of the caregiver's body, facing inwards or outwards. The baby carrier itself in preferred embodiments may be constructed in many different ways providing it basically holds the baby in an upright position against the caregiver's body with straps that go over the caregiver's shoulders. Preferred embodiments comprise a seat flap that enables the baby's weight to be distributed evenly along the baby's thighs and buttocks to create a supportive seat for the baby in all carrying positions.

Figure 1B:
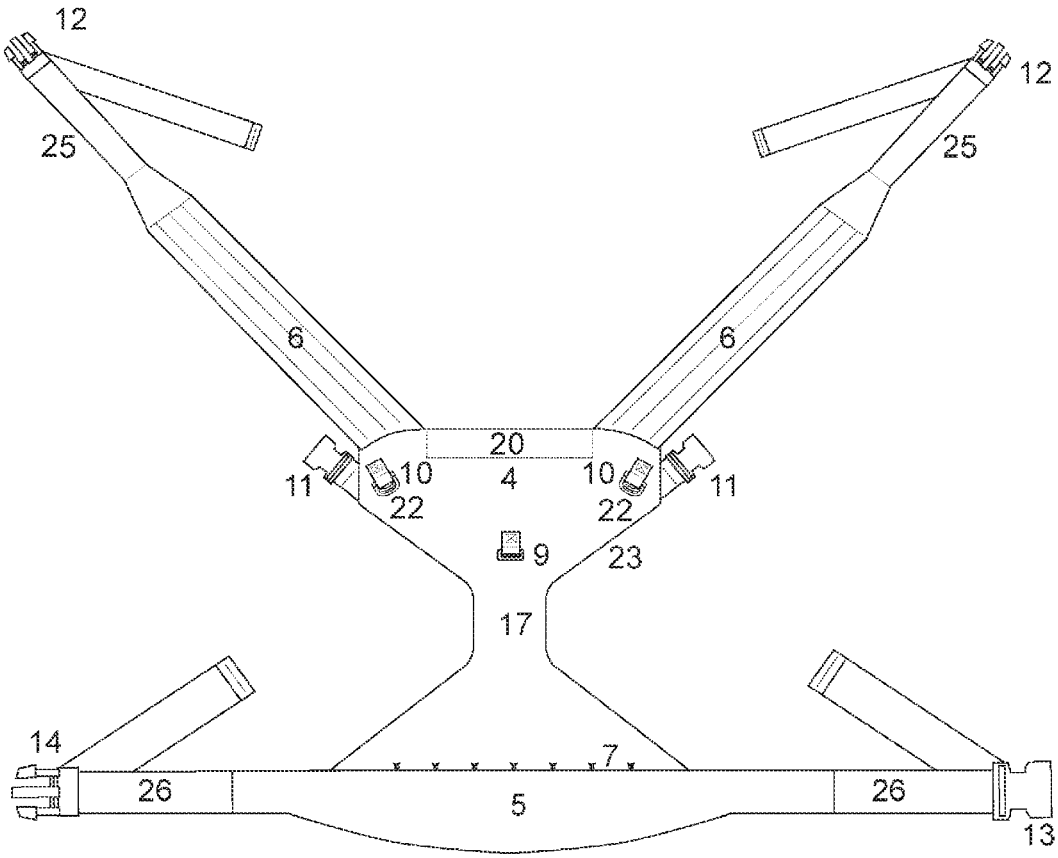
Figure 1C:
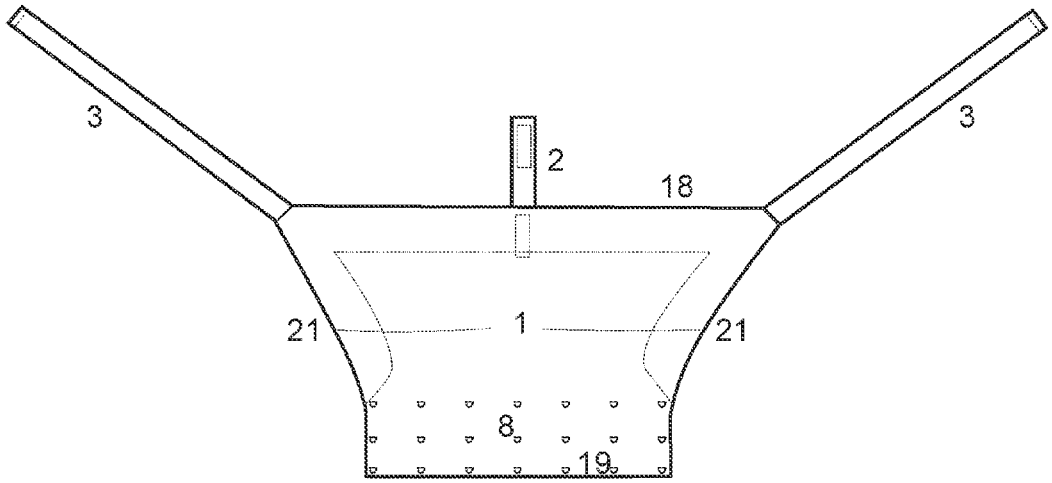
Figure 1D:
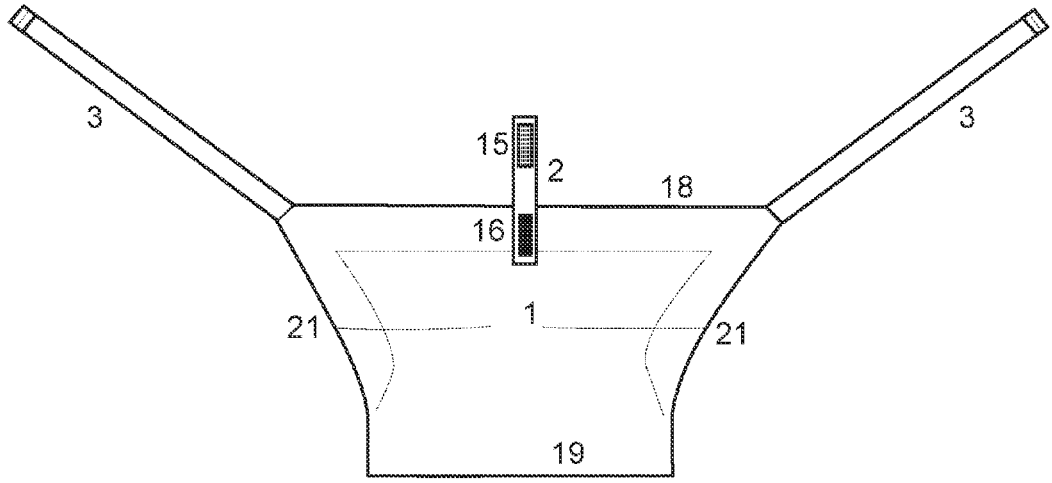

FIGS. 1A through 1D illustrate the anatomy of an exemplary baby carrier with a seat flap 1, in accordance with an embodiment of the present invention. FIG. 1A is a ¾ view of the baby carrier in a disassembled state. FIG. 1B is a diagrammatic front view of a main body 23 of the baby carrier. FIG. 1C is a diagrammatic top view of seat flap 1, and FIG. 1D is a diagrammatic bottom view of seat flap 1. In the present embodiment, the baby carrier comprises a baby pouch 4, which is a flap of fabric shaped to create a narrow crotch region 17 to allow the baby's legs to stick out the front of the carrier when in a facing-out position. A bottom edge 19 of baby pouch 4 attaches to a padded waistband 5 that is secured in back by connectors such as, but not limited to, adjustable side-release plastic buckles 13 and 14, which are attached to waistband 5 with extension straps 26. In alternate embodiments various different types of connectors made of various different materials may be used to secure the waistband such as, but not limited to, snaps, conventional buckles, clasps, slide buckles, etc. In the present embodiment, waistband 5 is adjustable in length to accommodate a wide range of body sizes for the caregiver. Shoulder straps 6 are attached to upper corners 22 of baby pouch 4. Shoulder straps 6 wrap over the caregiver's shoulders, cross in back and attach by connectors such as, but not limited to, side-release plastic buckles 11 and 12 to the region of baby pouch 4 close to the armpit areas on the opposite sides of the body. Buckles 11 and 12 attach to shoulder straps 6 with extension straps 25. In alternate embodiments the shoulder straps may attach with different types of connectors such as, but not limited to, snaps, conventional buckles, clasps, slide buckles, etc. and may be configured differently; for example, without limitation, the straps may not cross in back. In the present embodiment, shoulder straps 6 are preferably lightly padded for comfort but not bulky enough to interfere with crossing in the back; however in alternate embodiments the shoulder straps may not be padded. In the present embodiment, the lengths of shoulder straps 6 are adjustable to fit a wide range of body sizes. In some alternate embodiments, the two shoulder straps may be constructed as one piece that crosses in the back like a one piece harness rather than two separate straps.

Referring to FIG. 1A, main body 23 of the baby carrier is shown with seat flap 1 removed to illustrate and how seat flap 1 attaches to main body 23 of the carrier. The attachments that connect seat flap 1 to main body 23 are adjustable to accommodate a range of baby sizes. The present embodiment is preferably sized to fit babies from three months old to three years old. However, alternate embodiments may be implemented to fit a smaller range of babies. A bottom edge 24 of seat flap 1 is attached to main body 23 of the baby carrier with fasteners so that the height of the seat flap can be lengthened or shortened for smaller or bigger babies. In the present embodiment these fasteners are hook and eye closures. There are multiple rows of hooks 8 along the width of bottom edge 24 of seat flap 1 to accommodate different lengths of baby thighs, and where seat flap 1 meets bottom edge 19 of baby pouch 4 there is a row of eyes 7 to which hooks 8 attach. In alternate embodiments the seat flap may be attached to the main body of the baby carrier using various different means such as, but not limited to, snaps, hook and loop material, zippers, etc. In the present embodiment, straps 3 on a top edge 18 of seat flap 1 attach to main body 23 of the baby carrier with adjustable connectors such as, but not limited to, D-rings 10 that are attached near upper corners 22 of baby pouch 4. Other types of adjustable connectors that may be used to attach the straps of the seat flap to the main body of the carrier in alternate embodiments include, without limitation, snaps, buckles, hook and loop material, etc. In the present embodiment, a crotch strap 2 at the center of top edge 18 of seat flap 1 is preferably adjustable in length as well to accommodate babies of different sizes. Crotch strap 2 loops through a connector such as, but not limited to, a ring 9 that is attached to the front of baby pouch 1 and folds back to fasten seat flap 1 to ring 9 with an adjustable fastener such as, but not limited to, hook and loop fasteners 15 and 16. In alternate embodiments the crotch strap may fasten the seat flap to the baby pouch using various different means such as, but not limited to, snaps, buckles, clasps, etc. In the present embodiment, crotch strap 2 can be removed or its position can be adjusted to match the length of seat flap 1. It should be noted that the crotch strap is optional. It makes the seat flap work better and more secure, however, in many practical applications, technically, the seat flap could work without the crotch strap; for example, without limitation, if the baby cooperated and doesn't moves his legs too much.

Referring to FIGS. 1C and 1D, seat flap 1 is preferably shaped with sewn darts to create a bucket seat shape to better fit the shape of a baby's buttocks and thighs. However, the seat flap in alternate embodiments may be a flat piece of material. In the present embodiment, side edges 21 and top edge 18 of seat flap 1 are padded where they come in contact with the baby's thighs for the comfort of the baby. Referring to FIG. 1B, various parts of main body 23 of the carrier including, but not limited to, waistband 5, shoulder straps 6 and baby pouch 4 may be padded for the comfort of the baby or the caregiver. A top edge 20 of the baby pouch 4 may also be padded where it comes into contact with the baby's upper chest. Some embodiments may be implemented without padding, for example, without limitation, embodiments that are made of especially soft material. In the present embodiment, main body 23 and seat flap 1 are preferably made out of a soft but durable material such as, but not limited to, cotton twill, canvas, corduroy, or denim. Furthermore, all clasps and attachment mechanisms are preferably placed on the carrier so that the carrier is reversible, providing two different fabric options for the caregiver to wear. In order to reverse the carrier, the caregiver removes seat flap 1 and attaches it to the other side of main body 23. Alternate embodiments of the present invention may be implemented that are not reversible.

In the present embodiment, all straps and connectors are preferably detachable and adjustable to accommodate babies of different sizes. However, alternate embodiments may be implemented where some or all of the straps and connectors are not adjustable. For example, without limitation, the seat flap connectors do not necessarily need to be adjustable. In addition, some straps and connectors may not be detachable, for example, without limitation, the seat flap may be permanently attached to the main body of the baby carrier and still serve its function.

In the present embodiment, extension straps 25 and 26 may be made of various materials such as, but not limited to, webbing, fabric, leather, etc. In some embodiments, extension straps 25 and 26 may be integrated into main body 23 of the baby carrier or seat flap 1 as a continuous piece of fabric. Embodiments utilizing fabric straps may be more aesthetically pleasing; however these embodiments may be more difficult to adjust. In some embodiments, the carrier may comprise a hood or support of some kind for the baby's head that is secured by adjustable straps that change the length of the hood depending on how tall the baby is. In some embodiments comprising a hood or head support, this hood or head support may be detachable.

The present embodiment as illustrated by way of example in FIGS. 1A through 1D includes baby pouch 4, which is similar to many baby carriers on the market. As explained in the background section, the manner in which the baby pouches in currently known carriers are constructed and connect to the shoulder straps varies widely, with some carriers having more features and complex constructions. However, the present embodiment comprises seat flap 1, which may be adapted to almost any baby carrier of this type on the market regardless of how complexly or simply the carrier is constructed. For example, without limitation, embodiments of the present invention comprising seat flaps may be implemented for use with baby carriers with rigid frames, soft-structured baby carriers, wrap-style baby carriers, mei tais, onbuhimos, podaegis or other Asian-inspired baby carriers, etc.

Figure 2A:
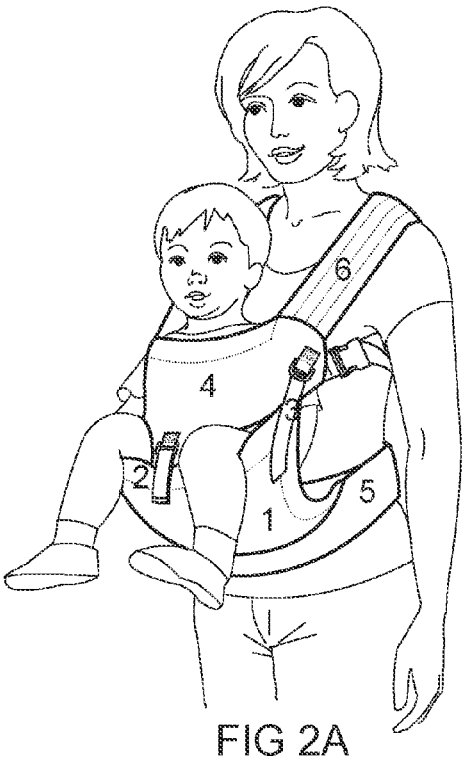
FIGS. 2A through 2C illustrate an exemplary baby carrier with a seat flap in use with a baby in multiple carrying positions, in accordance with an embodiment of the present invention.
Figure 2B:
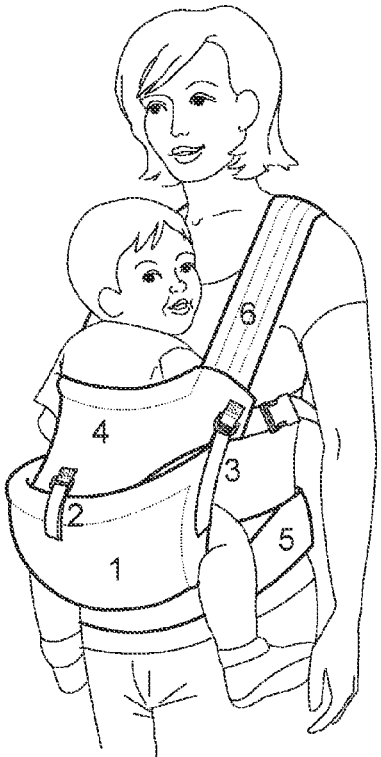
Figure 2C:
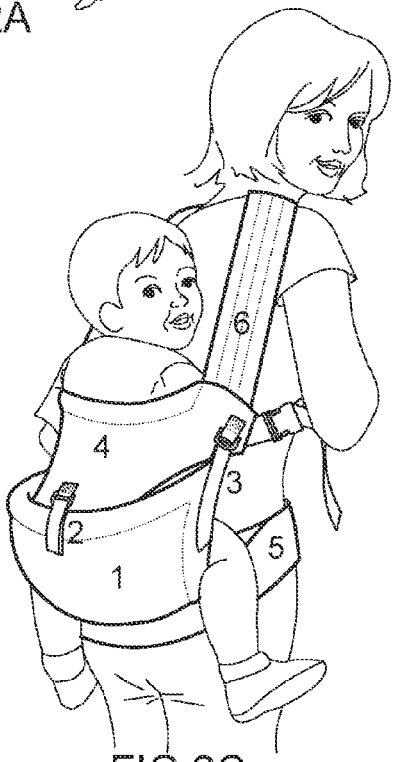

FIGS. 2A through 2C illustrate an exemplary baby carrier in use with a baby in multiple carrying positions, in accordance with an embodiment of the present invention. FIG. 2A is a ¾ view of the baby carrier being worn by a caregiver with the baby in a front carry facing-out position. FIG. 2B is a ¾ view of the baby carrier being worn by the caregiver with the baby in a front carry facing-in position, and FIG. 2C is a ¾ view of the baby carrier being worn by the caregiver with the baby in a back carry position. In the present embodiment, the baby carrier comprises a baby pouch 4 with shoulder straps 6 to secure the baby in an upright position to the front or back of the caregiver's body. The baby carrier also comprises a seat flap 1 that attaches to baby pouch 4 at or near the bottom edge of baby pouch 4, near where baby pouch 4 attaches to a waistband 5 or generally where the baby's buttocks are located if the baby is in the facing-out position. In typical use of the present embodiment, shoulder straps 6 go over the caregiver's shoulders and attach to baby pouch 4 near the armpits of the caregiver. Shoulder straps 6 may or may not cross in the back. Waistband 5 is wrapped around the waist of the caregiver and attached with fastening means on the caregiver's back. The baby may then be placed in baby pouch 4 in any of the positions illustrated by way of example in FIGS. 2A through 2C.

Referring to FIG. 2A, a top edge 18 of seat flap 1 has a strap 3 in each corner so that when the baby is in the facing-out position, pulling up on straps 3 causes seat flap 1 to cup under the baby's buttocks and top edge 18 of seat flap 1 to hook into the area behind the baby's knees. Straps 3 then attach to the main body of the baby carrier on the upper part of the carrier in the region close to the caregiver's armpits creating a seat or sling for the baby's thighs so that the baby's legs do not dangle down from the crotch and the baby's weight is distributed along the baby's thighs and buttocks rather than being concentrated at the crotch. In alternate embodiments, the point of attachment for the seat flap straps could be somewhere around the upper region of the carrier to maximize comfort for the caregiver. The position may have to be adjusted so that it attaches higher up on the carrier like on the shoulder straps or perhaps further back toward the armpits like on the straps where the shoulder straps loop under the caregiver's armpits. It should be appreciated that, in many practical applications, the point of attachment may not necessarily be on the baby pouch as described in the present embodiment. In the front carry facing-out position, the baby can face outwards while his thighs and buttocks are securely cradled and supported by seat flap 1 in a seated position conducive to healthy spine and hip development. Seat flap 1 acts as a sling for the baby's thighs and buttocks that is separate from baby pouch 4, which holds the baby's torso.

Referring to FIG. 2B, the baby is turned around and facing into the caregiver's body to illustrate how the baby's legs stick out side edges 21 of seat flap 1 and how the baby's buttocks and thighs are equally supported in the front carry facing-in position. In this position, the carrier functions similarly to most of the other carriers on the market of this style that do not allow babies to face out. The baby's legs are held at a 90-degree or greater angle because the thighs are supported and the baby's legs straddle the caregiver's body. Straps 3 on top edge 18 of seat flap 1 can be adjusted in length for better fit and support of the baby when switching between the facing-out and facing-in positions.

Referring to FIG. 2C, the baby is positioned on the back of the caregiver's body facing into the caregiver's body with the baby's legs sticking out side edges 21 of seat flap 1. The baby's buttocks and thighs are supported. The baby's legs are held at a 90-degree or greater angle because the thighs are supported and the baby's legs straddle the caregiver's body.

Figure 3:
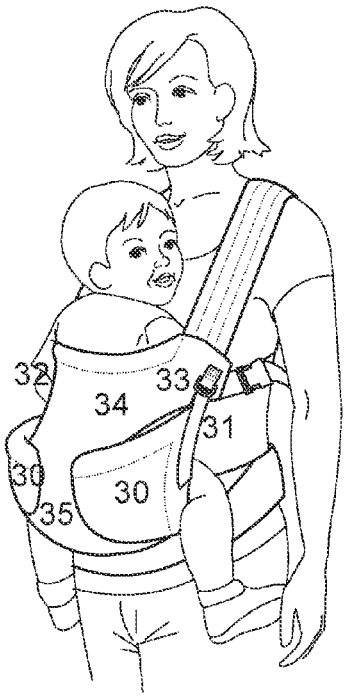
FIG. 3 is a ¾ view of an exemplary baby carrier comprising two separate seat flaps, in accordance with an embodiment of the present invention.

FIG. 3 is a ¾ view of an exemplary baby carrier comprising two separate seat flaps 30, in accordance with an embodiment of the present invention. In the present embodiment, seat flaps 30 are positioned under each thigh of the baby rather than one single seat flap across the width of the baby carrier as describe in the foregoing embodiment. Each separate seat flap 30 comprises a strap 31 on the upper edge corner that attaches to a main body 32 of the carrier near an upper corner 33 of a baby pouch 34. Each separate flap 30 in this embodiment is attached to baby pouch 34 at a crotch region 35 of baby pouch 34 eliminating the need for a crotch strap as described in the foregoing embodiment.

Figure 4:
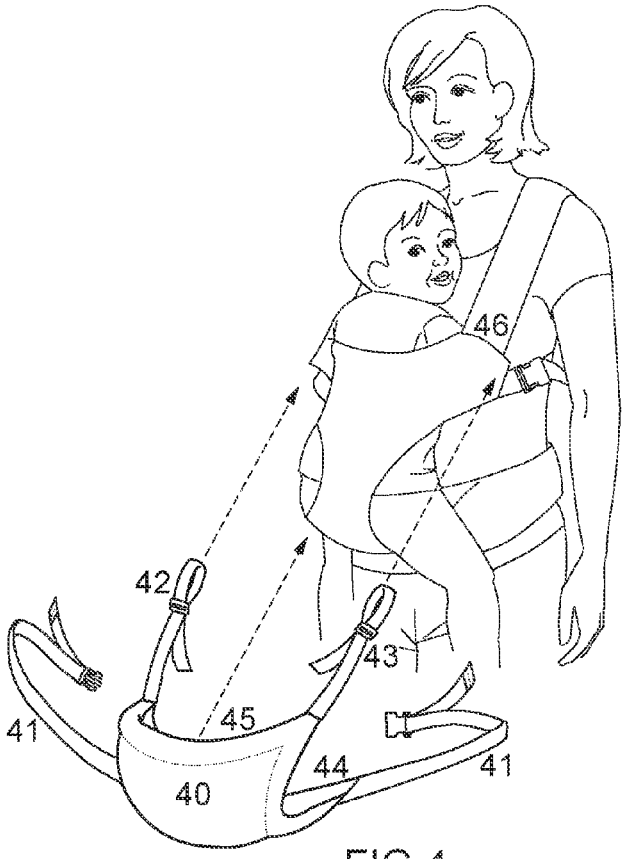
FIG. 4 is a ¾ view of an exemplary seat flap that may be used as an add-on accessory for existing baby carriers, in accordance with an embodiment of the present invention.

FIG. 4 is a ¾ view of an exemplary seat flap 40 that may be used as an add-on accessory for existing baby carriers, in accordance with an embodiment of the present invention. In the present embodiment, seat flap 40 comprises a waistband 41 attached at a bottom edge 44 to go around the caregiver's waist independent of the baby carrier being used. Seat flap 40 in this embodiment has straps 42 and 43 at the corners of an upper edge 45 that loop around a convenient point of attachment 46 on the baby carrier in use, creating a supportive seat for the baby's thighs and buttocks as described previously. The straps of seat flap 40 may attach to the existing baby carrier using means other than loops such as, but not limited to, snaps. Those skilled in the art, in light of the present teachings, will readily recognize that existing baby carriers may vary in construction and that embodiments of the present invention may be implemented to adapt to these variations in construction. For example, the baby pouch could be constructed so the pouch detaches at the upper corners from the shoulder strap with fasteners or straps. Or the baby pouch could have a high construction that extends high on the baby's body and includes armholes for the baby's arms to stick out. In these cases, the armholes or the extra fasteners or straps for attaching the baby pouch to the shoulder straps may be convenient attachment points for the seat flap straps 42 and 43.

Figure 5:
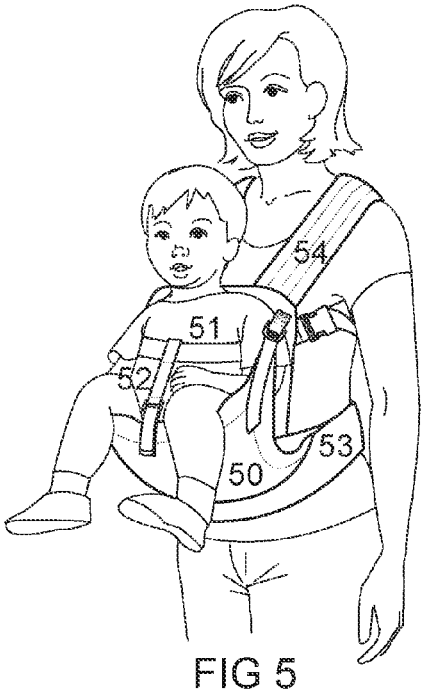
FIG. 5 is a ¾ view of an exemplary baby carrier comprising a seat flap that does not have a baby pouch, in accordance with an embodiment of the present invention.

FIG. 5 is a ¾ view of an exemplary baby carrier comprising a seat flap 50 that does not have a baby pouch, in accordance with an embodiment of the present invention. In the present embodiment, seat flap 50 provides almost all the support for the baby, attaching at the bottom or back to shoulder straps 54 and a waistband 53. Additional straps 51 that connect to a crotch strap 52 and shoulder straps 54 take the place of the support usually provided by a baby pouch.

Figure 6:
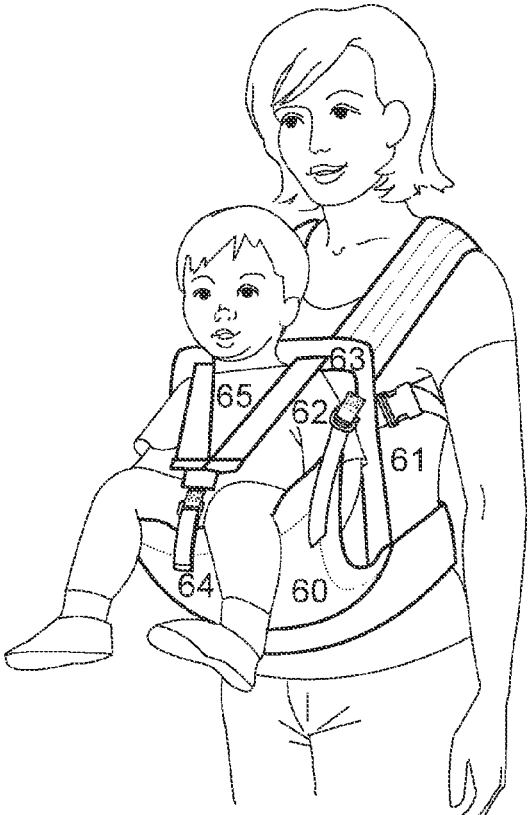
FIG. 6 is a ¾ view of an exemplary rigid frame baby carrier comprising a seat flap, in accordance with an embodiment of the present invention.

FIG. 6 is a ¾ view of an exemplary rigid frame baby carrier 61 comprising a seat flap 60, in accordance with an embodiment of the present invention. In the present embodiment, instead of a rigid framed seating platform as is typical with rigid frame baby carriers, baby carrier 61 comprises a flexible seat flap 60 that attaches with seat flap straps 62 to a backrest 63 of rigid frame baby carrier 61. The bottom edge of seat flap 60 is attached to rigid frame baby carrier 61 at the bottom of backrest 63. Seat flap 60 also comprises a crotch strap 64 that attaches to a shoulder harness 65 on rigid frame baby carrier 61. Those skilled in the art, in light of the present teachings, will readily recognize that existing rigid frame baby carriers may vary in construction and that embodiments of the present invention may be implemented to adapt to these variations in construction. For example the rigid frame baby carrier 61 could have a flexible baby pouch that secures the baby to the backrest 63 rather than the shoulder harness 65 illustrated in this embodiment. In this case the seat flap 60 could attach to points on the upper corners of the baby pouch similar to the way described in the preferred embodiment. As another example the backrest 63 could have side extensions that support the baby on the sides that the seat flap straps 62 could attach to.

Figure 7:
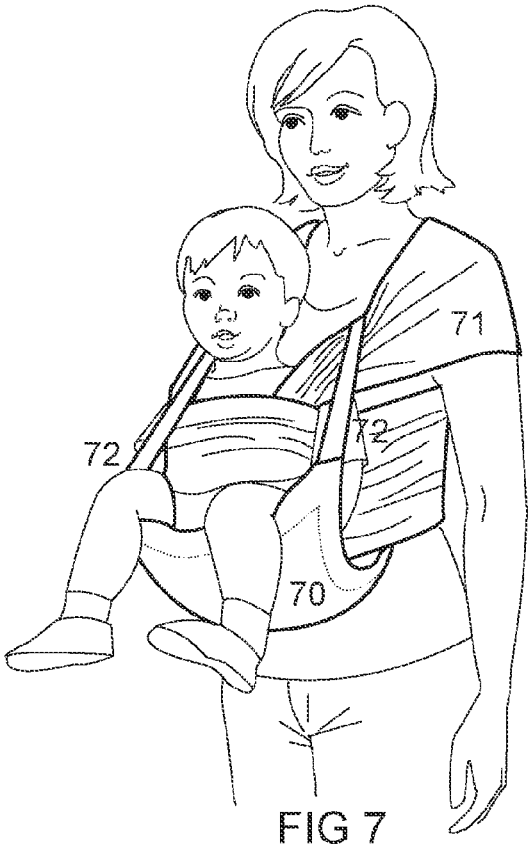
FIG. 7 is a ¾ view of an exemplary wrap style baby carrier with a seat flap in a front carry facing-out position, in accordance with an embodiment of the present invention.

FIG. 7 is a ¾ view of an exemplary wrap style baby carrier 71 with a seat flap 70 in a front carry facing-out position, in accordance with an embodiment of the present invention. Wrap-style baby carrier 71 is basically a long piece of fabric that wraps the baby securely to the caregiver's body in a variety of positions. In the front carry facing-out position, the baby's thighs are not typically supported well. However, as shown in the present embodiment, seat flap 70 may attach with seat flap straps 72 to the material of wrap style baby carrier 71 with fasteners such as, but not limited to, clips, hook and loop fasteners or snaps near the caregiver's armpits. The bottom edge of seat flap 70 may attach to the material behind the baby's buttocks with fasteners such as, but not limited to, clips, snaps, hook and loop fasteners, etc.

Figure 8:
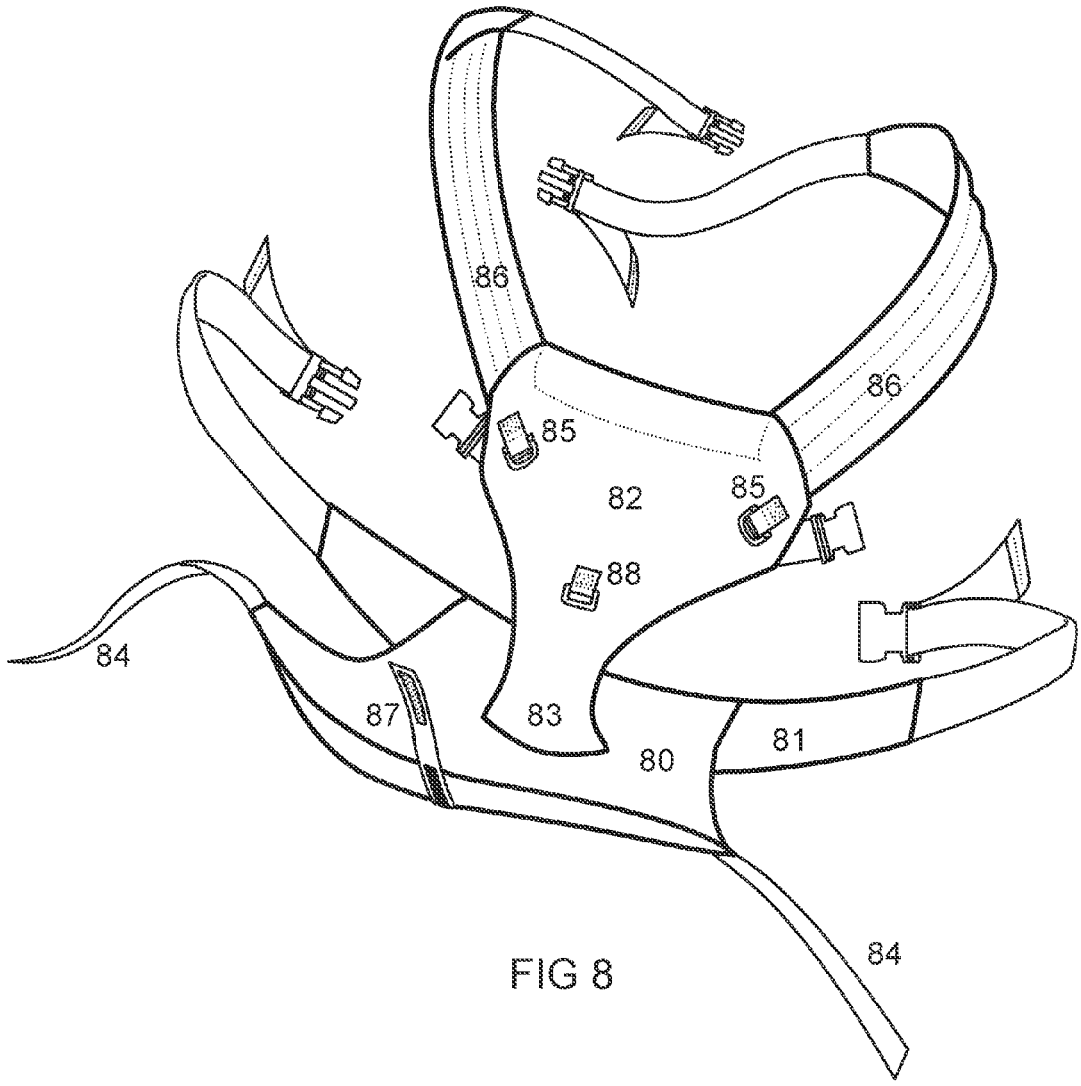
FIG. 8 is a ¾ view of an exemplary baby carrier comprising a seat flap attached to the baby pouch at the crotch, in accordance with an embodiment of the present invention.

FIG. 8 illustrates another alternate embodiment of the present invention directed to a soft-structured baby carrier with a seat flap comprising a seat flap 80 that fastens to the top edge of the waistband 81. The narrow crotch region 83 of the baby pouch 82 is attached to the center of the seat flap 80 either permanently or with adjustable connectors. Shoulder straps 86 connect to the top edge of the baby pouch 82. The seat flap straps 84 attach to the upper region 85 of the baby carrier. The seat flap 80 also comprises a crotch strap 87 that attaches to the center 88 of the baby pouch 82

Having fully described at least one embodiment of the present invention, other equivalent or alternative methods of providing a supportive baby carrier that enables a user to carry a baby in multiple positions according to the present invention will be apparent to those skilled in the art. The invention has been described above by way of illustration, and the specific embodiments disclosed are not intended to limit the invention to the particular forms disclosed. For example, the particular implementation of the seat flap may vary depending upon the particular type of baby carrier used. The carriers described in the foregoing were directed to wearable implementations; however, similar techniques are to provide seat flaps for other types of baby carrying devices such as, but not limited to, high chairs, swings, strollers, activity seats, etc. Non-wearable implementations of the present invention are contemplated as within the scope of the present invention. The invention is thus to cover all modifications, equivalents, and alternatives falling within the spirit and scope of the following claims.

Claim elements and steps herein have been numbered and/or lettered solely as an aid in readability and understanding. As such, the numbering and lettering in itself is not intended to and should not be taken to indicate the ordering of elements and/or steps in the claims.

What is claimed is:

1. An apparatus comprising:

means for supporting a majority of a baby's buttocks and the baby's thighs, wherein said supporting means includes a bottom edge that is the edge closest to the ground when the baby sits upright, a top edge that is the edge opposite said bottom edge at the center of said bottom edge, a first side edge extending from a first corner of said top edge to a first corner of said bottom edge, a second side edge extending from a second corner of said top edge and to a second corner of said bottom edge, and a top edge region;

means for joining said top edge corners of said supporting means to opposing side portions of a pouch of a baby carrier at an upper portion of a baby carrier; and means for joining said supporting means to a lower portion of the baby carrier, such that each of said side edges extends from a respective side portion of said upper portion of said pouch to said lower portion of said baby carrier, wherein, the baby carrier is configured for supporting the baby in a substantially upright position on a user, said supporting means engages the baby carrier from an exterior of the baby carrier and is disposed on the exterior of the baby carrier, the baby sits upright in an outward- or inward-facing orientation and the majority of the baby's thighs and buttocks are supported by said supporting means, in either orientation, such that the supporting means wraps under the majority of the baby's thighs defining a seat in the outward-facing orientation, the baby's legs are supported primarily by the top edge in said outward-facing orientation and supported primarily by an elongate region along each side edge, suspended between a respective one of the top edge corners and said lower portion, in said inward-facing orientation, at an angle upward from a vertical axis through the baby within the baby carrier, wherein said supporting means comprises a width extending from a center point of one side edge to a center point of the opposing side edge and height extending from a center point of said top edge to a center point of said bottom edge, and further wherein said width is no greater than twice said height, thereby allowing the baby's legs to project out through the elongate region of a respective one of said side edges in the inward-facing orientation; and a change in orientation of the apparatus and the baby carrier is not required for a change in facing orientation of the baby between said outward- and inward-facing orientations.

2. The apparatus as recited in claim 1, further comprising means for joining a top edge region of said supporting means to the baby carrier, wherein said joining means extends between said top edge region of said supporting means to a central exterior portion of the baby carrier.

3. An apparatus comprising:

a seat flap for supporting a majority of a baby's buttocks and the baby's thighs in a sling like fashion, said seat flap including a bottom edge that is the edge closest to the ground when the baby sits upright, a top edge that is the edge opposite said bottom edge at the center of said bottom edge, and further having a top edge region, a bottom edge region and opposing side edge regions;

a first strap for joining a first corner of said top edge region to one side portion of an upper portion of a baby carrier;

a second strap for joining a second corner of said top edge region to the opposing side portion of said upper portion; and attachments for joining said bottom edge region about a lower portion of the baby carrier, wherein, said first strap and said second strap each extend in a substantially radial direction away from a central region of the seat flap, the baby carrier is configured for supporting the baby in a substantially upright position on a user, said seat flap engages the baby carrier from an exterior of the baby carrier and is disposed on the exterior of the baby carrier, the baby sits upright in an outward- or inward-facing orientation and the majority of the baby's thighs and buttocks are supported by said seat flap, in either orientation, such that the baby's legs are supported primarily by the top edge in said outward-facing orientation and supported primarily by respective side edge regions in said inward-facing orientation, at an angle upward from a vertical axis through the baby within the baby carrier, and a change in orientation of the apparatus and the baby carrier is not required for a change in facing orientation of the baby between said outward- and inward-facing orientations.

4. The apparatus as recited in claim 3, further comprising a crotch strap for joining said top edge region to the baby carrier, wherein said crotch strap extends between said top edge region of said seat flap to a central exterior portion of the baby carrier.

5. The apparatus as recited in claim 3, wherein said seat flap comprises two portions.

6. The apparatus as recited in claim 3, wherein said attachments provide for adjustable joining of the bottom edge region about the lower portion.

7. The apparatus as recited in claim 6, wherein said attachments comprise one or more hook and eye closures, snaps, straps and strap length adjusters, or any combination of the foregoing.

8. The apparatus as recited in claim 3, wherein said first strap and said second strap are joined to the upper portion with adjustable connectors.

9. The apparatus as recited in claim 3, wherein said seat flap and /or baby carrier are reversible for enabling different exterior looks.

10. The apparatus as recited in claim 3, wherein said attachments are permanently fixed.

11. A baby carrier system, comprising:

a pouch comprising an upper first end region, a lower second end region, and a middle region disposed between said first and second end regions; wherein said middle region narrows to a smaller lateral width than the first and second end regions;

first and second elongate shoulder straps each comprising a first end and a second end connected and releasably connectable, respectively, at respective portions of the first end region of the pouch;

a waistband connected at the second end region of the pouch; and a seat flap comprising a bottom edge that is the edge closest to the ground when the baby sits Upright-including first and second corners, a top edge that is the edge opposite said bottom edge at the center of said bottom edge, said top edge including first and second corners, and further including a bottom edge region, first and second side edges extending between said first corner of said top edge and said bottom edge and between said second corner of said top edge and said bottom edge, respectively, and a plurality of straps that extend in a substantially radial direction away from a central portion of said seat flap for joining said first and second corners of said top edge adjacent to said first end region of said pouch, and with said bottom edge region comprising attachments generally along the direction of its lateral width for joining said bottom edge region adjacent to at least one of said second end region of said pouch, said middle region of said pouch, or said waistband; wherein said side edges of said seat flap at least in part define respective passages through which the baby's legs can pass out of said seat flap when the baby is in an inward-facing orientation, said smaller lateral width of said middle region of said pouch in combination with said top edge of said seat flap at least in part define respective passages through which the baby's legs can pass out of said baby carrier system when the baby is in an outward-facing orientation, and the seat flap wraps under the majority of the baby's thighs defining a seat in the outward-facing orientation; and wherein the flap covers at least a portion of the second end region of the pouch, the middle region of the pouch, or a combination of the foregoing.

12. The baby carrier system of claim 11, wherein at least one of the connections of said seat flap to said pouch comprises a detachable connection.

13. The baby carrier system of claim 11, wherein at least one of the connections of said seat flap edges to said pouch comprises a permanently fixed connection.

14. The baby carrier system of claim 11, wherein, in operation, a baby sits upright in an outward- or inward-facing orientation and the baby's legs are supported by said seat flap, in either orientation, at an angle upward from a vertical axis through the baby within the baby carrier system, and a change in orientation of the baby carrier system is not required for a change in facing orientation of the baby between said outward- and inward-facing orientations.

15. The baby carrier system of claim 11, wherein at least a portion of said first end region and at least a portion of said second end region narrows laterally in a direction towards said middle region.

16. The baby carrier system of claim 11, further comprising a crotch strap for joining said top edge to the pouch.

17. The baby carrier system of claim 11, further comprising an adjustable attachment system for connection of the seat flap to the pouch so that at least one of the flap edges can selectively be moved towards and away from its closest pouch edge.

18. The baby carrier system of claim 17, wherein said adjustable attachment system comprises one or more hook and eye fasteners, snaps, straps and strap length adjusters, or any combination of the foregoing.

19. The system of claim 11, wherein at least one of said adjacent connections comprises an abutting connection.

20. A baby carrier system, comprising:

a pouch comprising an upper first end region and a lower narrowing region, adjacent to said first end region, which narrows to a smaller lateral width than the first end region; said narrowing region comprising an upper portion adjacent to said first end region and a bottom edge;

first and second elongate shoulder straps each comprising a first end and a second end connected and releasably connectable, respectively, at respective portions of the first end region of the pouch;

a seat flap comprising a bottom edge that is the edge closest to the ground when the baby sits upright wherein said bottom edge includes first and second corners, a top edge that is the edge opposite said bottom edge at the center of said bottom edge, wherein said top edge includes first and second corners, and further including a bottom edge region, first and second side edges extending between said first corner of said top edge and said bottom edge and between said second corner of said top edge and said bottom edge, respectively, and a middle region between said top edge and said bottom edge;

a waistband connected at the bottom edge of the seat flap; and, first and second connections comprising first and second seat-flap straps that extend in a substantially radial direction away from a central portion of said seat flap for joining said first and second corners of said top edge, respectively, adjacent to said first end region of said pouch, and a third connection for connecting said middle region, said bottom edge of said seat flap, or said waistband generally along the lateral width of said bottom edge of said narrowing region of said pouch, wherein said side edges of said seat flap at least in part define respective passages through which the baby's legs can pass out of said seat flap when the baby is in an inward-facing orientation, said smaller lateral width of said narrowing region of said pouch in combination with said top edge of said seat flap at least in part define respective passages through which the baby's legs can pass out of said baby carrier system when the baby is in an outward-facing orientation, and the seat flap wraps under the majority of the baby's thighs defining a seat in the outward-facing orientation.

21. The system of claim 20, further comprising a crotch strap for joining said top edge to the pouch.

22. The system of claim 20, further comprising an adjustable attachment system for connection of the seat flap to the pouch so that at least one of the flap edges can selectively be moved towards and away from its closest pouch edge.

23. The system of claim 22, wherein said adjustable attachment system comprises one or more hook and eye fasteners, snaps, straps and strap length adjusters, or any combination of the foregoing.

24. The system of claim 20, wherein, in operation, a baby sits upright in an outward- or inward-facing orientation and the baby's legs are supported by said seat flap, in either orientation, at an angle upward from a vertical axis through the baby within the baby carrier system, and a change in orientation of the baby carrier system is not required for a change in facing orientation of the baby between said outward- and inward-facing orientations.

25. The system of claim 20, wherein at least one of the connections of said seat flap to said pouch comprises a detachable connection.

26. The system of claim 20, wherein at least one of the connections of said seat flap to said pouch comprises a permanently fixed connection.

27. The system of claim 20, wherein at least one of said adjacent connections comprises an abutting connection.

28. An apparatus comprising:

means for supporting a majority of a baby's buttocks and the baby's thighs, said supporting means including a top edge region, and a bottom edge that is the edge closest to the ground when the baby sits upright, a top edge that is the edge opposite said bottom edge at the center of said bottom edge, a first side edge extending from a first corner of said top edge to a first corner of said bottom edge, and a second side edge extending from a second corner of said top edge and to a second corner of said bottom edge;

means for joining said top edge corners of said supporting means to opposing side portions of a pouch of a baby carrier at an upper portion of a baby carrier;

means for joining said supporting means to a lower portion of the baby carrier, such that each of said side edges extends from a respective side portion of said upper portion of said pouch to said lower portion of said baby carrier, wherein, the baby carrier is configured for supporting the baby in a substantially upright position on a user, said supporting means engages the baby carrier from an exterior of the baby carrier and is disposed on the exterior of the baby carrier, the baby sits upright in an outward- or inward-facing orientation and the majority of the baby's thighs and buttocks are supported by said supporting means, in either orientation, such that the supporting means wraps under the majority of the baby's thighs defining a seat in the outward-facing orientation, the baby's legs are supported primarily by the top edge in said outward-facing orientation and supported primarily by an elongate region of each side edge, suspended between a respective one of the top edge corners and said lower portion in said inward-facing orientation, at an angle upward from a vertical axis through the baby within the baby carrier, wherein said supporting means comprises a width extending from a center point of one side edge to a center point of the opposing side edge and height extending from a center point of said top edge to a center point of said bottom edge, and further wherein said width is no greater than twice said height, and with said supporting means adapted to allow the baby's legs to project out through the-elongate region of a respective one of said side edges in the inward-facing orientation; and a change in orientation of the apparatus and the baby carrier is not required for a change in facing orientation of the baby between said outward- and inward- facing orientations; and means for joining a center portion of said top edge region of said supporting means to the exterior of said baby carrier, wherein said joining means extends between said top edge region of said supporting means to a central exterior portion of the baby carrier.

29. The apparatus of claim 28, wherein said means for joining a center portion of said top edge region of said supporting means to the exterior of said baby carrier comprises an elongate crotch strap extending from said top edge region, and a connector on said baby carrier for attaching said crotch strap.

30. An apparatus comprising:

a seat flap for supporting a majority of a baby's buttocks and the baby's thighs in a sling like fashion, said seat flap including a bottom edge that is the edge closest to the ground when the baby sits upright, a top edge that is the edge opposite said bottom edge at the center of said bottom edge, and further including a top edge region, a bottom edge region and opposing side edge regions;

a first strap for joining a first corner of said top edge region to one side portion of an upper portion of a baby carrier;

a second strap for joining a second corner of said top edge region to the opposing side portion of said upper portion;

attachments for joining said bottom edge region about a lower portion of the baby carrier, wherein the baby carrier is configured for supporting the baby in a substantially upright position on a user, said seat flap engages the baby carrier from an exterior of the baby carrier and is disposed on the exterior of the baby carrier, the baby sits upright in an outward- or inward-facing orientation and the majority of the baby's thighs and buttocks are supported by said seat flap, in either orientation, such that the baby's legs are supported primarily by the top edge in said outward-facing orientation and supported primarily by respective side edge regions in said inward-facing orientation, at an angle upward from a vertical axis through the baby within the baby carrier, and a change in orientation of the apparatus and the baby carrier is not required for a change in facing orientation of the baby between said outward- and inward-facing orientations; and a crotch strap for joining said top edge region of said seat flap to a central exterior portion of the baby carrier, wherein said crotch strap extends between said top edge region of said seat flap to a central exterior portion of the baby carrier.

* * * * *